US005782186A

United States Patent [19]

McTaggart

[11] Patent Number: 5,782,186

[45] Date of Patent: Jul. 21, 1998

[54] MODEL MOTOR VEHICLE TRACK SYSTEM AND METHOD FOR MAKING THE SAME

[75] Inventor: Stephen I. McTaggart, Scottsdale, Ariz.

[73] Assignee: Futech Educational Products, Inc., Phoenix, Ariz.

[21] Appl. No.: 775,956

[22] Filed: Jan. 3, 1997

[51] Int. Cl.[6] ..... A63G 31/00

[52] U.S. Cl. ..... 104/60; 104/305; 104/53; 191/22 R; 238/10 F

[58] Field of Search ..... 104/53, 60, 295, 104/305; 191/13, 22 R; 238/10 F, 10 C, 10 A

[56] References Cited

U.S. PATENT DOCUMENTS

| | | | |
|---|---|---|---|
| 3,202,109 | 8/1965 | Stewart | 104/60 |
| 3,288,368 | 11/1966 | Athearn | 238/10 F |
| 3,395,861 | 8/1968 | Kindred | 238/10 F |
| 3,424,379 | 1/1969 | Giammarino et al. | 238/10 F |
| 3,780,235 | 12/1973 | Deyerl et al. | 191/13 |
| 3,874,301 | 4/1975 | Alimanestianu | 104/295 |
| 4,349,196 | 9/1982 | Smith et al. | 104/295 |

*Primary Examiner*—Mark T. Le
*Attorney, Agent, or Firm*—Quarles & Brady

[57] ABSTRACT

A model vehicle course is laid out along a non-conductive, printable substrate such as a heavy paper or plastic, which is typically, but not necessarily, non-rigid. First and second conductive deposits are made along at least one of the surfaces of the substrate extending, mutually spaced-apart, along the path for each vehicle accommodated by the given layout to supply electrical energization to the vehicle as it traverses the course. In one presently preferred embodiment of the invention, the conductive deposits constitute conductive ink layers emplaced by a conventional printing step. The characteristics of the conductive ink selected for use and the concentration—width and thickness—of its deposits are controlled to ensure a sufficiently low resistance along the lengths of the conductive deposits feeding a given vehicle as to establish the desired performance at the furthest distance from feed points at which a detachable control unit/power supply is coupled to the conductive deposits, preferably by conductive traces printed on a lower surface of the substrate. Various sensors and output devices are similarly connected to the control unit to provide sound effects and lap/time information. In one embodiment, a plurality of detachable control units are employed to permit a corresponding plurality of operators to compete, each controlling a given model vehicle. This embodiment has the added advantage of permitting the substitution of different courses without the necessity for duplicating the control units.

26 Claims, 10 Drawing Sheets

MODEL MOTOR VEHICLE TRACK SYSTEM AND METHOD FOR MAKING THE SAME

FIELD OF THE INVENTION

This invention relates to the art of model motor vehicles and, more particularly, to a model vehicle track incorporating conductor laminae disposed along the vehicle course to energize one or more model vehicles and to a method for making such a model vehicle track.

BACKGROUND OF THE INVENTION

Motorized model vehicles adapted to traverse a course laid out on a model track system are well known in the art. In one particularly popular configuration, a model race course for two or more motorized model vehicles is laid out on a suitable substrate, and a pair of wire or rail conductors are partly embedded along the length of the course for each model vehicle, typically one on either side of and generally parallel to a guide slot which serves to constrain the model vehicle to stay on course. A pair of trailing brush members depends from each model vehicle to pick up voltage from the immediately adjacent pair of partially embedded conductors by sliding along the exposed surfaces thereof to thereby energize the model vehicle as it traverses the course.

The magnitude of the voltage applied across the pair of conductors associated with a given motor vehicle, and hence the instantaneous speed of the vehicle, is typically under the control of an operator who can quickly vary the voltage as he/she watches the progress of "his/her" vehicle as it traverses the course, perhaps in competition with one or more other model vehicles running the course along parallel tracks and under the control of one or more other operators. In this fashion, entertaining and demanding competitions can be carried out is such a manner that the skill and hand-to-eye coordination of the operators tends to build in value for life pursuits in addition to the direct enjoyment of controlling the model vehicles.

The commercially available systems for such model vehicles vary greatly in expense and complexity, but high quality and expansive layouts are certainly expensive, and one particular point of expense is in the track layout. Typically, at least partly because of the need to physically partially embed or otherwise secure in place the pairs of conductors for energizing each vehicle, the track layouts, which can be single piece or assembled from a plurality of pieces, are emplaced integrally on a rigid substrate which contributes a certain amount to the expense of the layout. The process of embedding or otherwise permanently emplacing the conductors is relatively complex and expensive to carry out. The end result is somewhat unwieldy to handle because of the rigid nature of the layout and is not easy to store, even if fabricated from a series of assembled pieces.

Thus, it will be readily apparent to those skilled in the art that it would be highly desirable to provide a model motor vehicle system in which a course is situated on a non-rigid, even foldable layout and in which the necessity for embedding or otherwise securing conductor pairs along the course for each model motor vehicle accommodated is obviated.

OBJECTS OF THE INVENTION

It is therefore a broad object of this invention provide an improved model vehicle system incorporating a course layout.

It is a more specific object of this invention to provide such a model vehicle system in which a course layout overlays a non-rigid, even foldable substrate.

In another aspect, it is an object of this invention to provide such a model vehicle system in which it is unnecessary to provide embedded or otherwise emplaced discrete wire or rail conductors disposed along the path along the course of a given model vehicle.

In yet another aspect, it is an object of this invention to provide a model vehicle course layout which is inexpensive to fabricate and very flexible with respect to layout configuration.

In still yet another aspect, it is an object of the invention to provide a model course layout which is easy to store and setup and which take up only modest room in storage and yet can be elaborate when arrayed in operating configuration.

SUMMARY OF THE INVENTION

Briefly, these and other objects of the invention are achieved by laying out a model vehicle course along a non-conductive substrate which is typically, but not necessarily, non-rigid. Such a substrate, for example, can constitute a heavy paper or plastic and may include fold regions by which it may be folded up for storage. First and second conductive deposits are made along at least one of the surfaces of the substrate extending, mutually spaced-apart, along the path for each vehicle accommodated by the given layout to supply electrical energization to the vehicle as it traverses the course. In one presently preferred embodiment of the invention, the conductive deposits constitute conductive ink layers emplaced by a conventional printing step. The characteristics of the conductive ink selected for use and the concentration—width and thickness—of its deposits are controlled to ensure a sufficiently low resistance along the lengths of the conductive deposits in order to establish the desired performance of a vehicle at the furthest distance from feed points at which a conventional variable voltage control unit/power supply is coupled to the conductive deposits. If desired or necessary, booster conductive deposits can be printed on the opposite side of the substrate to extend directly between the feed points and the conductive deposits feeding the model vehicles in the regions most remote, calculated along the vehicle path, from the feed points. This expedient ensures high performance of the vehicle throughout its course by maintaining a predetermined minimum voltage under load at the region(s) most remote from the feed points.

The model vehicles employed with the layout prepared in accordance with the invention may be conventional, employing a spring loaded pair of solid, conductive brush pickups, or, preferably, may be slightly modified by the use of flexible, braided flat conductor elements at the pickup points between the model vehicles and the conductive deposits.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DESCRIPTION OF THE PREFERRED EMBODIMENT(S)

Figure 1:
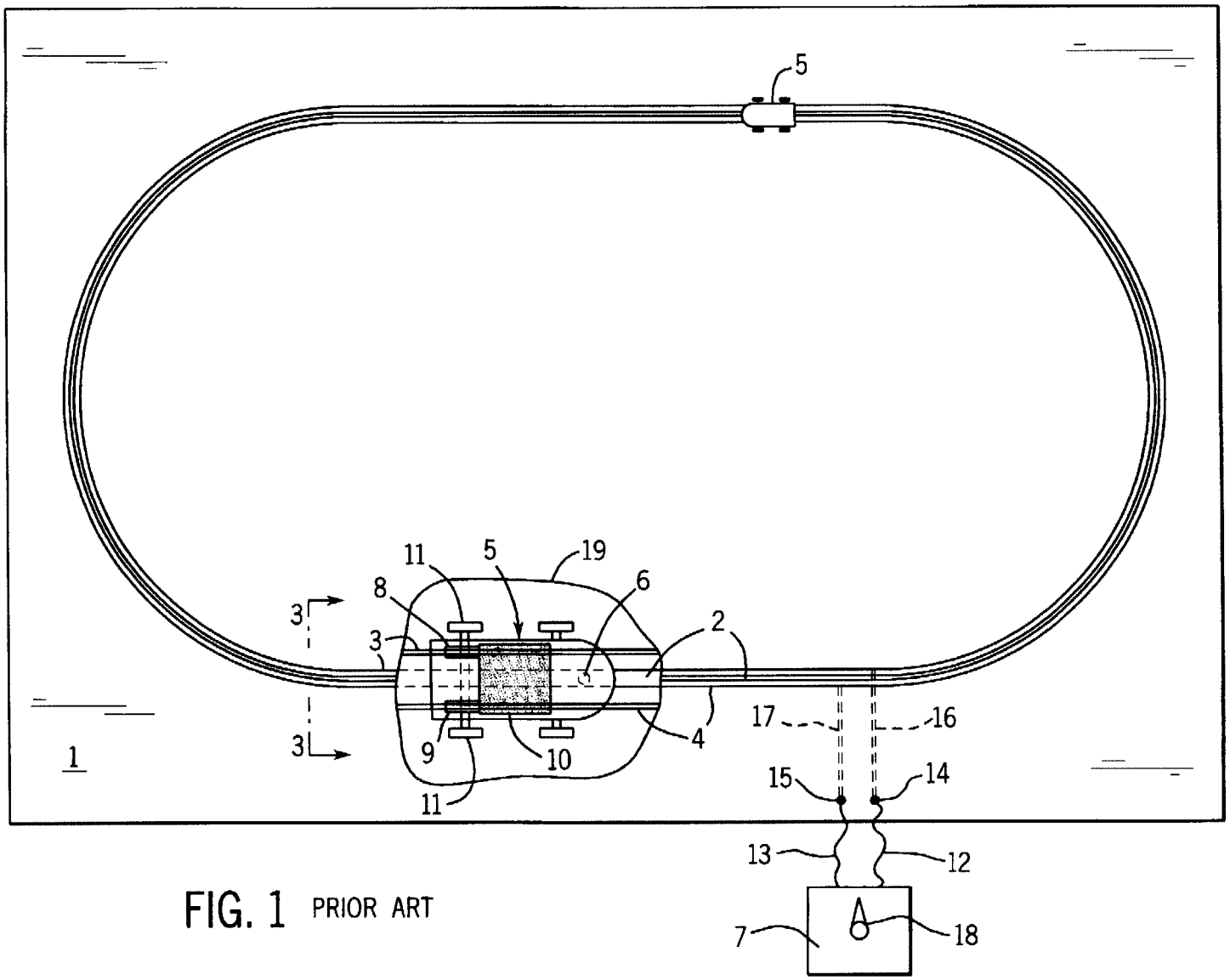
FIG. 1 PRIOR ART
FIG. 1 is a plan view representation of a typical prior art model race car layout.

Referring first to FIG. 1, there is shown a very basic, exemplary prior art configuration for a model vehicle layout. The layout is carried by a rigid substrate 1 and includes a single vehicle oval course generally defined by a guide slot 2. Disposed adjacent the guide slot 2 and running generally parallel to it are first and second conductors 3, 4 which are partially embedded in or otherwise fixed to the substrate 2.

Figure 2:
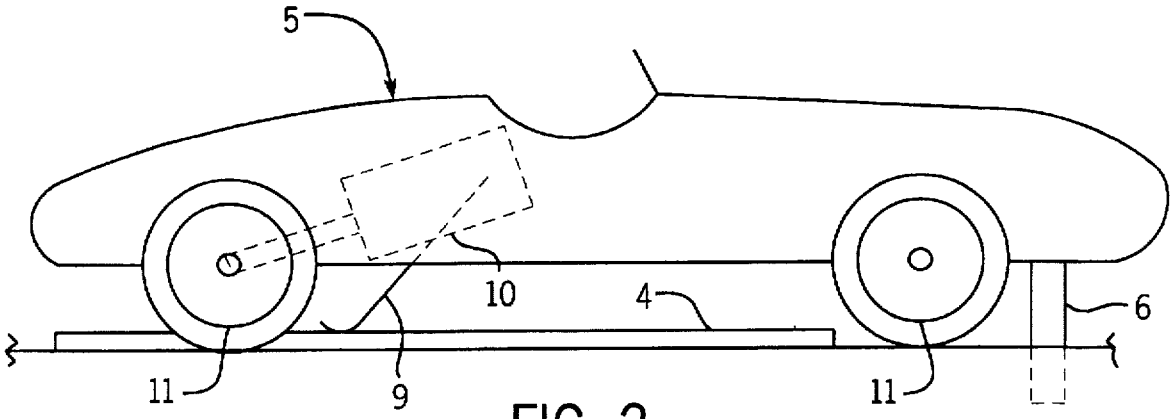
FIG. 2 PRIOR ART
FIG. 2 is a pictorial of a typical conventional model race car which may be employed with the layout illustrated in FIG. 1.

Referring particularly to the magnified region 19 of FIG. 1 and also to FIG. 2, a representative model race car 5 is provided with a downwardly depending guide post 6 which constrains the race car to normally follow the oval course defined by the guide slot 2. An integral electric motor 10 drives wheels 11, through any suitable expedient such as a gear train, to impel the car around the oval course at a speed dependent upon the voltage picked up by downwardly depending brushes 8, 9 from first 3 and second 4 partially embedded conductors. The conductors 3, 4 are electrically energized by a power pack 7 which has a variable voltage output coupled to the conductors 3, 4 by leads 12, 13 which are detachably connected to terminals 14, 15. Supply conductors 16, 17 are connected, respectively, between the terminals 14, 15 and the first 3 and second 4 partially embedded conductors. Thus, as well known in the art, the rate at which the race car 5 traverses the course defined by the guide slot 2 may be dynamically controlled by an operator manipulating the control 18 of power pack 7 while watching the progress of the race car. Typically, conductors 3, 4 are each connected in a closed loop.

Figure 3:
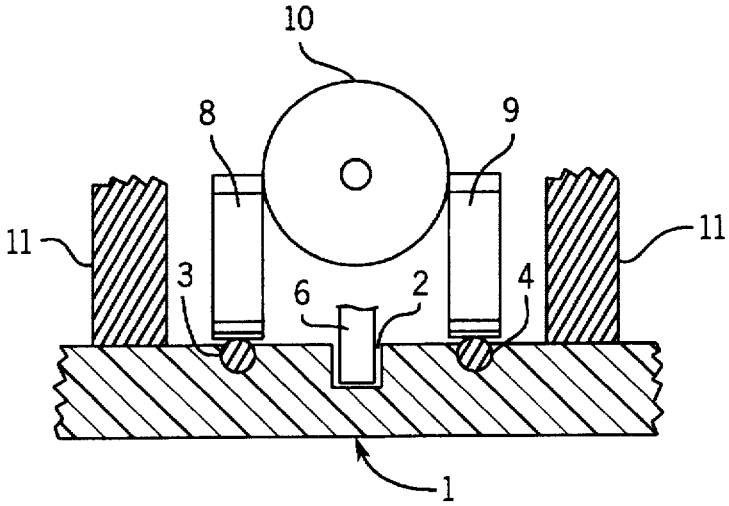
FIG. 3 PRIOR ART
FIG. 3 is a cross sectional partial view, take along the lines 3—3 in FIG. 1 and particularly illustrating certain structure which is typical of the prior art model race car layouts.

The partial cross sectional, partial view of FIG. 3 shows certain of the typical structure of the prior art model vehicle layout shown in FIG. 2. Thus, conductors 3, 4 are partially embedded in the rigid substrate 1, and downwardly depending brushes 8, 9 slidingly engage the exposed upper surface of the conductors to supply current to the electric motor 10 which drives wheels 11. Downwardly depending guide post 6 rides in guide slot 2 to constrain the model race car to follow a prescribed path.

Figure 4:
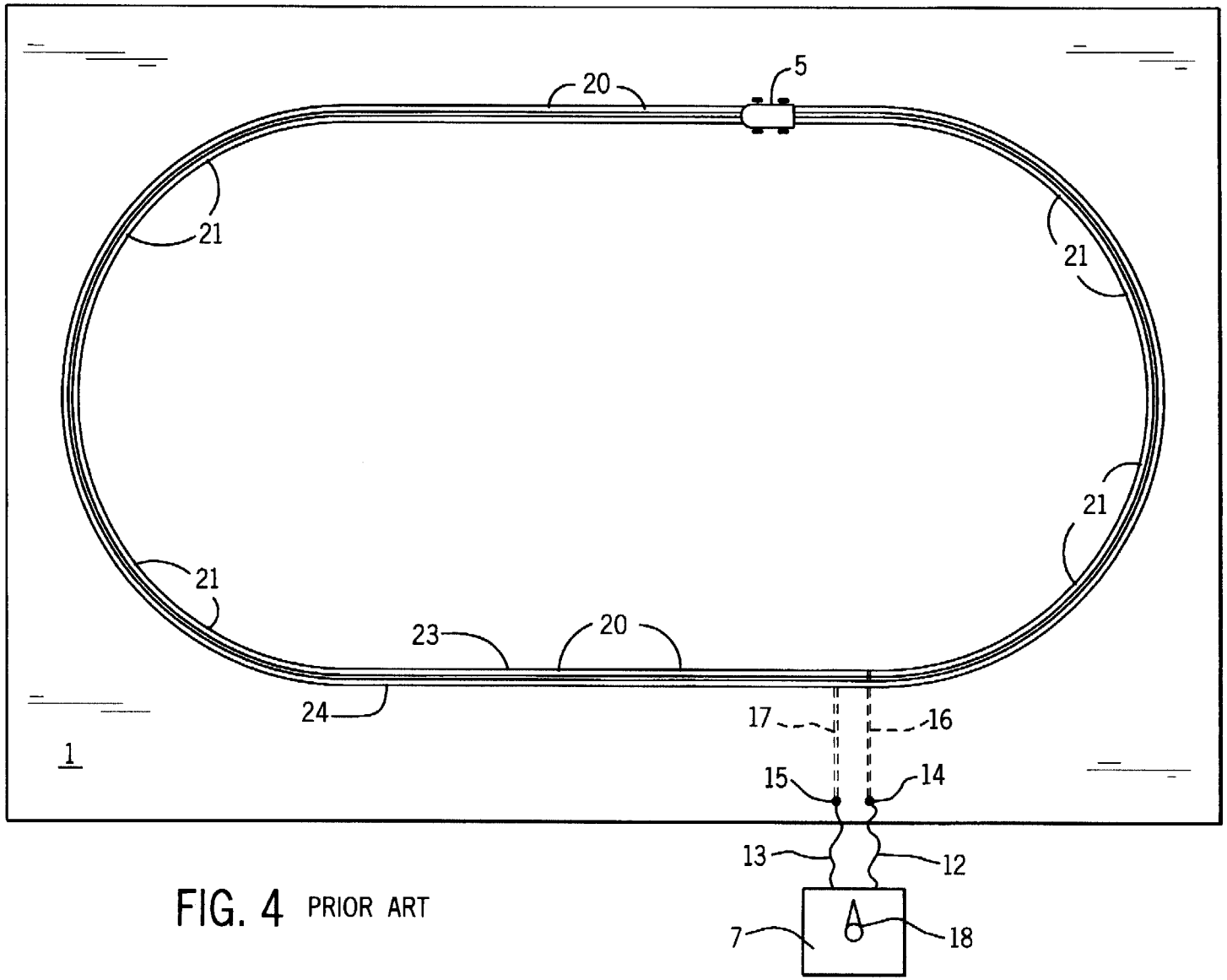
FIG. 4 PRIOR ART
FIG. 4 is a plan view of a typical prior art sectional model race car layout.

Of course, those skilled in the art will recognize that the model vehicle layout thus far described is very elementary, and much more elaborate layouts for accommodating two or more individually controlled model vehicles on a single layout are very well known. However, the general structure is typically like or similar to that shown in FIGS. 1 and 3. As shown in FIG. 4, the course may be made up of a certain number of interlocking straight segments 20 and curved segments 21 which fit together to maintain continuity of the partially embedded conductors 23, 24 and alignment of the guide slot 25.

Figure 5:
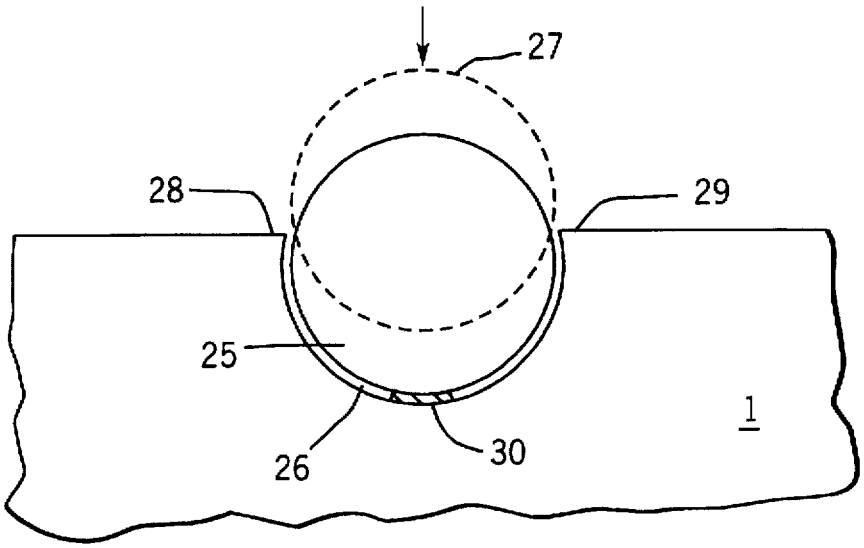
FIG. 5 PRIOR ART
FIG. 5 is a partial cross sectional view illustrating how partially embedded conductors are typically emplaced to convey power to a model vehicle along a prior art model race car layout.

The conductors 3, 4, 23, 24 may be fixed in place in/on the rigid substrate 1 by several processes. Typically, either adhesive is used or pressure is applied to the upper surface of a conductor to snap it into place into a previously prepared slot. With the latter expedient, the slot which receives the conductor is slightly narrower at the top to retain the conductor once it has been forced into place. For example, referring to FIG. 5, the cross section of the slot 26, part of a circle, receives the circular conductor 25 as a result of pressure on its upper surface 27 to force it past the slot tips 28, 29 and into permanent position where it is retained by the slot tips 28, 29. If desired, of course, adhesive 30 could be optionally employed to ensure the security of the conductor 25 once it has been snapped into position.

Figure 6:
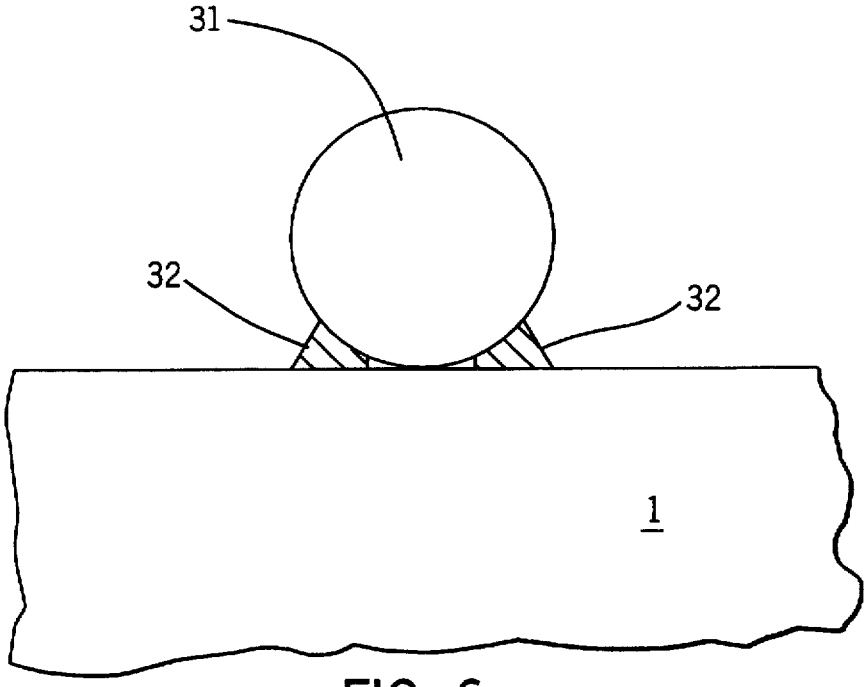
FIG. 6 PRIOR ART
FIG. 6 is a partial cross sectional view similar to FIG. 5 and illustrating an alternative expedient for emplacing conductors used emplaced to convey power to a model vehicle along a prior art model race car layout.

FIG. 6 illustrates an alternative arrangement for fixing in place the conductors which supply current to the model vehicle. In this configuration, an exemplary conductor 31 is held in place atop the substrate 1 by adhesive 32 laid along substantially its entire length on both sides.

A model vehicle layout in accordance with the present invention is very different from the prior art as described above and similar prior art. In two particularly important aspects: first, the discrete conductor pairs laid along the course of a given model vehicle path to convey current from the power pack to the vehicle as it traverses its course are eliminated, and second, the substrate supporting the layout is not necessarily rigid and may even incorporate the feature of being foldable. The manner in which these and other features are realized may be understood from the following discussion with reference to FIGS. 7–16.

Figure 7:
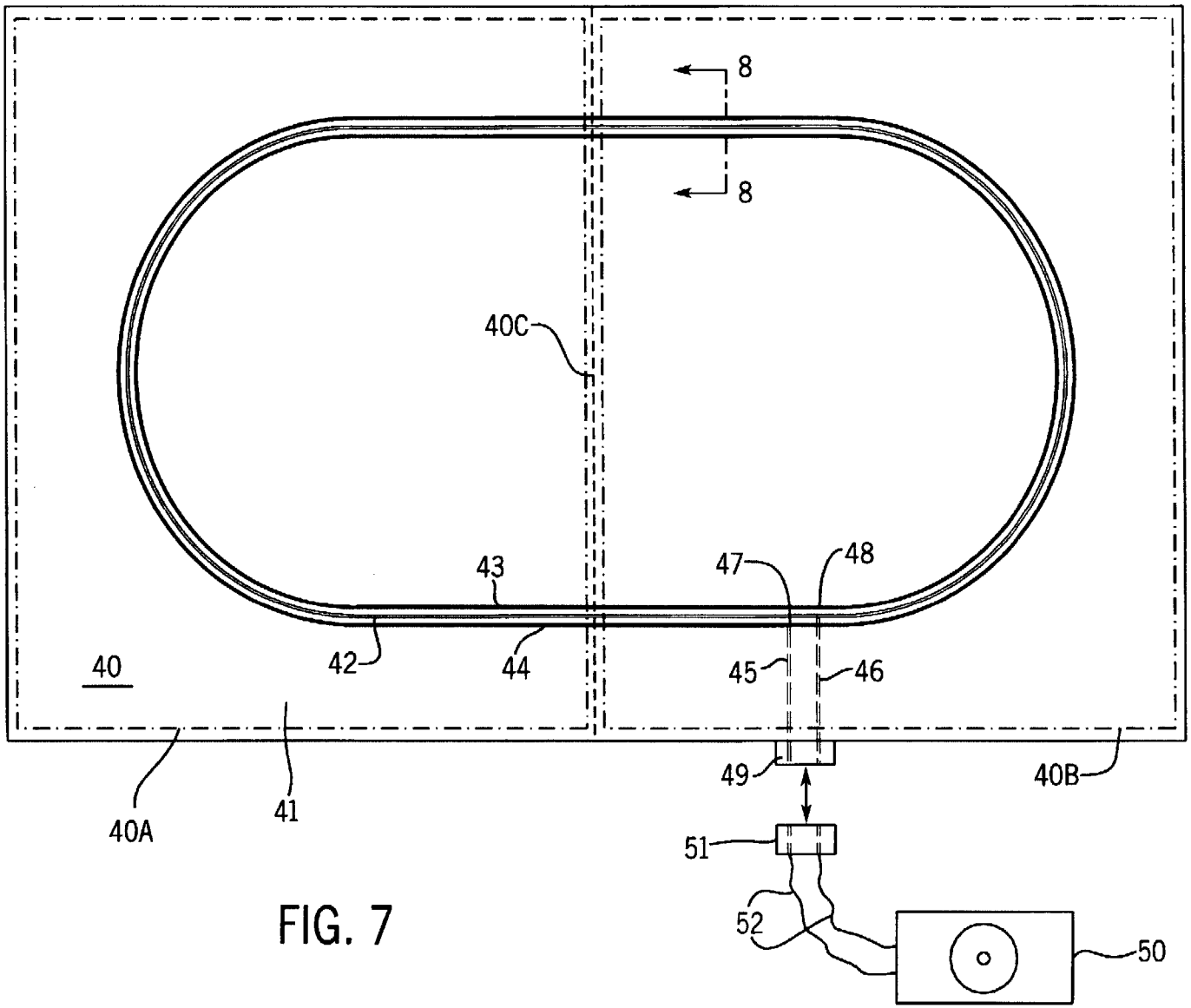
FIG. 7 is a basic, single model vehicle layout which incorporates the subject invention.

Thus, referring now to FIG. 7, there is shown an exemplary, basic layout made in accordance with the subject invention. A substrate 40 has an upper surface 41 which is characterized by its being printable; e.g., the surface will accept and retain imprinted patterns of ink. One particularly suitable choice for the material from which the substrate 40 is fabricated is non-conductive heavy paper. Another suitable material is an imprintable sheet of non-conductive plastic such as Mylar®. It will be understood, therefore, that the substrate 40 need not necessarily be rigid. If desired, the substrate 40 may be reinforced by a more rigid lower substrate. In addition, as shown in FIG. 7, two lower substrates 40A, 40B may be employed for the two halves of the substrate 40, the two lower substrates 40A, 40B being placed slightly spaced apart where their respective edges abut. Thus, the entire structure may be readily folded along fold line 40C for compact storage.

A guide slot 42 is provided to define a path or course to be followed by a model vehicle. Disposed on opposite sides of the guide slot 42 are first 43 and second 44 conductive deposits. Conductive deposits 43, 44 are not discrete conductors emplaced as indicated above, but are conductive deposits laid down on the surface 41. In a presently preferred embodiment of the invention, conductive deposits 43, 44 are printed traces of conductive ink laid down, as by printing, to a predetermined thickness and width to obtain adequate conductivity along the entire length of the course.

In the basic example shown in FIG. 7, power is coupled to the conductive deposits 43, 44 via similar conductive deposits 45, 46 laid on the underside of the substrate 40. Conductive through-holes or other feed-through expedients may be placed at 47, 48 to complete the circuit to the conductive deposits 43, 44 through the thickness of the substrate 40. The other ends of the conductive deposits 45, 46, in one embodiment, terminate at a fixed connector 49 which may conveniently be integral with substrate 40 to facilitate connection to a control unit/power pack 50 via connector 51, which is detachably mateable with fixed connector 49, and optional extension 52. As in an alternative configuration to be discussed in a more elaborate version discussed below and shown in FIG. 10, connector 51 may be integral with control unit/power pack 50 which is therefore detachably fixed directly to substrate 40 at connector 49, eliminating extension 52.

Figure 8:
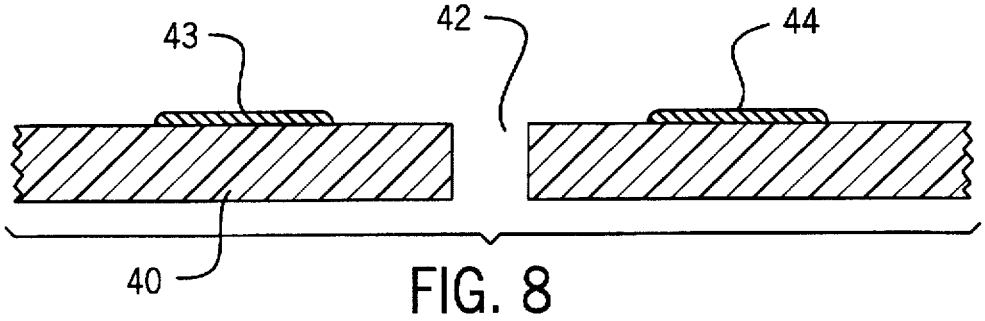
FIG. 8 is a cross sectional view taken along the lines 8—8 of FIG. 7 showing the deposits of conductive ink which transfer current from the power source to a model vehicle.
Figure 9A:
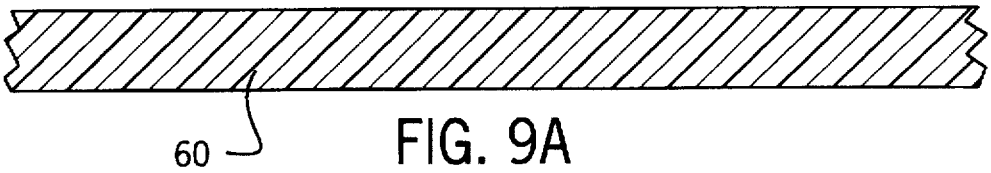
FIGS. 9A, 9B and 9C are views similar to FIG. 8 showing successive steps in an alternative process for depositing the conductive ink and making the guide slot for a model vehicle layout.
Figure 9B:
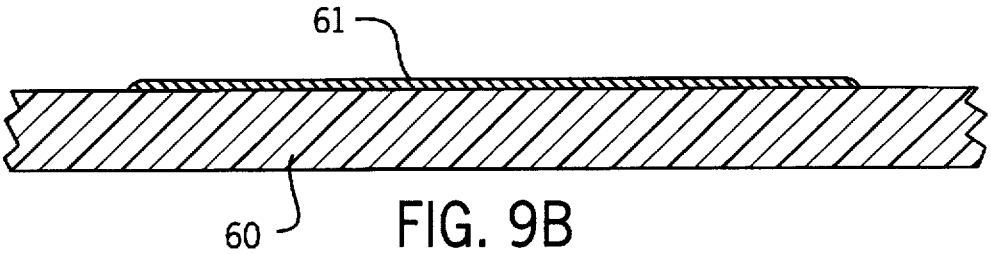
Figure 9C:
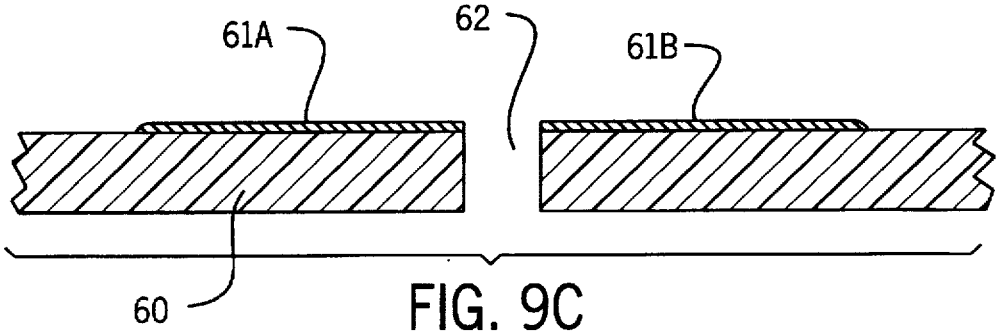

FIG. 8 is a cross sectional view taken along the lines 8—8 of FIG. 7 and illustrates that the conductors 43, 44 are spaced apart from one another with each separated from the guide slot 42 in the substrate 40. While this pattern can be produced in accordance with the principles of the invention, FIGS. 9A, 9B, 9C show successive steps in the production of a track which both simplify the process and produce a wider surface for each conductor feeding a vehicle around a track. Thus, FIG. 9A shows a printable substrate 60 of any suitable material as described before. Referring to FIG. 9B, as a first step in preparing a track, a conductive lamina 61 is laid down, as by printing with conductive ink, on top of the substrate 60 along the length of the track and to a width which includes the outermost edges of the two conductive deposits which will serve to energize a model motor vehicle. Next, as shown in FIG. 9C, a guide slot 62 is cut, die cut, punched, or otherwise fashioned in the substrate 60. Simultaneously, the conductive lamina 61 is divided into electrically isolated conductive laminae 61A, 61B.

It will be observed that this simple fabrication process results in the maximum width for each of the conductive traces from which a model vehicle directly picks up energy. Correspondingly, for a given conductive material imprinted or otherwise laid down to a given thickness, conductivity is maximized. Therefore, performance of a model vehicle at a remote position from the feedpoint from the power supply to the conductive deposits along the track length can be maintained to the desired degree without unduly increasing the thickness of the laminae 61A, 61B.

Figure 10:
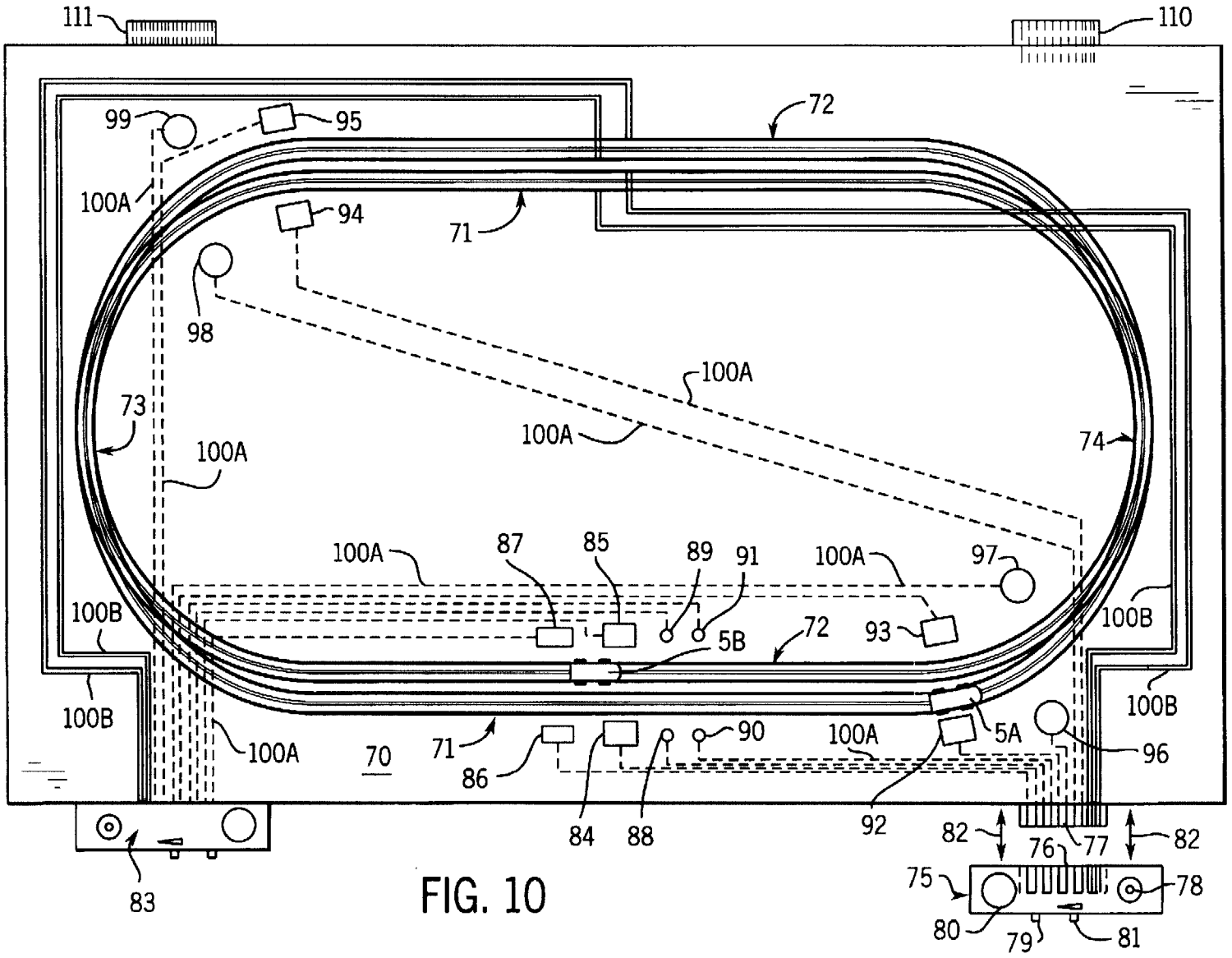
FIG. 10 shows an exemplary model vehicle track accommodating two vehicles, having various operational features and fabricated in accordance with the present invention.

FIG. 10 shows a more elaborate and practical model vehicle layout incorporating several aspects of the invention. (For clarity of illustration, the cross section of FIG. 8, rather than that of FIG. 9C, for the conductive deposits laid along the length of the course to feed the model vehicle via pickup brushes is employed.) Thus, a substrate 70 supports a two-vehicle course including first vehicle track 71 and second vehicle track 72 which cross (e.g., over-and-under) in the regions 73, 74. This layout is merely representative of the almost innumerable layouts possible for accommodating one, two or more model vehicles around a track such as a model race track.

The layout of FIG. 10 incorporates a number of features which can be implemented in accordance with the present invention. A first control unit 75 includes not only speed control circuitry coupled to the track 72, but also input/output circuitry which is responsive to sensors situated about the layout for sending predetermined sensory information back to the layout. Preferably, the control unit 75 is detachably connectable (as represented by the arrows 82) to the layout by, for example, coupling integral female connector 76 (shown in phantom in FIG. 10) with male connector 77 which is integral with the layout supported on the substrate 70. The control unit 75 may include one or more of speed control 78, on/off switch 79, audio speaker 80 and volume control 81 as well as internal circuitry which will be described in further detail below with respect to FIG. 16. A second detachable control unit 83, shown connected to the layout in FIG. 10, permits a second operator to control the second track 72 and to enjoy the same features as the operator of the first track 71 such that the operators can compete in the well known manner.

Representative of the numerous devices which can be incorporated into a given layout are start-finish sensors 84, 85 (which may be, e.g., conventional optical sensors); lap counters/timers 86, 87 (e.g., alphanumeric liquid crystal displays); signal lights 88, 89, 90, 91 (e.g., light emitting diodes); corner sensors 92, 93, 94, 95 (e.g., optical sensors); and speakers 96, 97, 98, 99. Electrical connections are made between the various devices incorporated into the layout and the control units 75, 83 by conductive traces 100A (shown in phantom in FIG. 10 to indicate that the traces are deposited beneath the upper printable surface of the substrate 70) running electrically between the male connectors (e.g., male connector 77) and the individual devices. For clarity in the illustration, single traces are shown between the connectors and the individual devices. Those skilled in the art will understand that each device must be provided with a second electrical side, typically a common ground, by another trace.

In addition, power for energizing the vehicles is conveyed from the control units 75, 83 to the tracks 71, 72 by heavier conductive traces 100B (in the example, deposited below the upper printable surface of the substrate 70) also shown in phantom in FIG. 10.

Consider the various features shown in FIG. 10. As model vehicle 5A traverses its course, it periodically passes start-finish sensor 84 which signals this information to the control unit 75. Control unit 75 processes this information and issues appropriate signals to lap counter/timer 86 and/or signal lights 88, 90. Similarly, corner sensor 92 senses the immediate passage of model vehicle 5A as it enters the associated corner. This information is sent to control unit 75 which is pre-programmed to respond by issuing suitable sound effects (e.g., squalling tire sounds with the addition of a crash sound if the speed of the model vehicle 5A as it enters the corner is sufficiently high) which are sent to the speaker 96. Corner sensor 94 correspondingly governs sound effects issued by the speaker 98 as model vehicle 5A enters the opposite corner. As will be apparent, the sensors and sensory output devices associated with the other model vehicle 5B operate in a corresponding manner. In this manner, exciting and realistic competitions between the model vehicles 5A, 5B may be held under control of separate operators operating the control units 75, 83.

Another important feature previously mentioned is that the control units 75, 83 are detachable. This feature permits the use of the control units, which are the most expensive components of a layout according to the invention, with different tracks which may, for example, be laid out in the shape of famous tracks such as Indianapolis, Darlington, Daytona, Taledega, Phoenix, etc., etc. and including road courses such as Monte Carlo, Riverside, Silverstone, etc., etc. In this manner, a large collection of courses may be enjoyed using the detachable control units 75, 83 without the necessity for purchasing and storing complete layouts. This feature is further facilitated by rendering the layouts fabricated in accordance with the invention foldable for compact storage as will be discussed in more detail below.

An optional, additional feature which may advantageously incorporated into the model vehicle layout shown in FIG. 10 is that it may be reversible with a complete second layout disposed on the side out of view in FIG. 10. Control to this second layout may be obtained by moving the control units 75, 83 to the male connectors 110, 111. While the connections to the second layout are not shown in FIG. 10, their implementation will be discussed below with respect to FIG. 16.

Attention is now directed to FIGS. 11, 12, 13, 14 and 15 which show various embodiments of the printed wiring employed according to the invention. Transfer leads to the conductive deposits 61A, 61B (FIGS. 9A, 9B, 9C and the discussion above with respect thereto) for energizing the model vehicles are taken as exemplary. In the representations of conductive and dielectric deposits shown, their thicknesses have been greatly exaggerated to facilitate an understanding of the functional relationships between the several deposits and layers.

Figure 11:
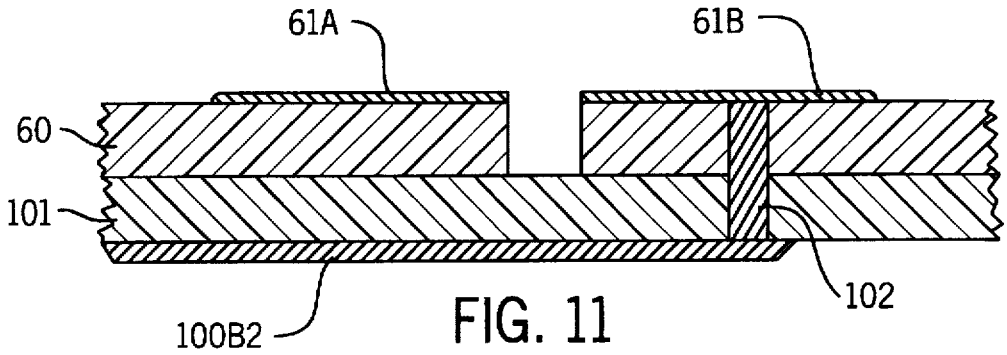
FIG. 11 is a view similar to FIG. 9C showing a first embodiment for the connections between the conductive deposits and a power source.

Thus, as shown in FIG. 11, the substrate 60 on which the conductive deposits 61A, 61B have been laid as previously described may be selectively stiffened by a rigid lower substrate 101. Deposited on the lower surface of the lower substrate 101 is conductive trace 100B2 which leads to conductive feedthrough 102 which extends vertically through the substrates 60, 101 to connect the conductive trace 100B2 to the conductive deposit 61B.

Figure 12:
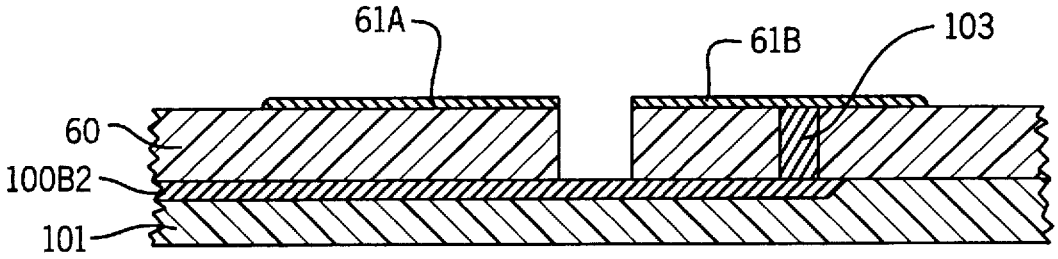
FIG. 12 is a view similar to FIG. 11 showing a second embodiment for the connections between the conductive deposits and a power source.

FIG. 12 illustrates a variant configuration in which the conductive trace 100B2 is deposited on the lower surface of the substrate 60, and electrical connection is made to the conductive deposit 61B on the upper surface of the substrate by feedthrough 103. With this arrangement, rigid lower substrate 101 not only stiffens the structure, but also serves to insulate the conductive trace 100B2 from wear, or even a possible electrical short, which could be experienced with the configuration of FIG. 11.

Figure 13:
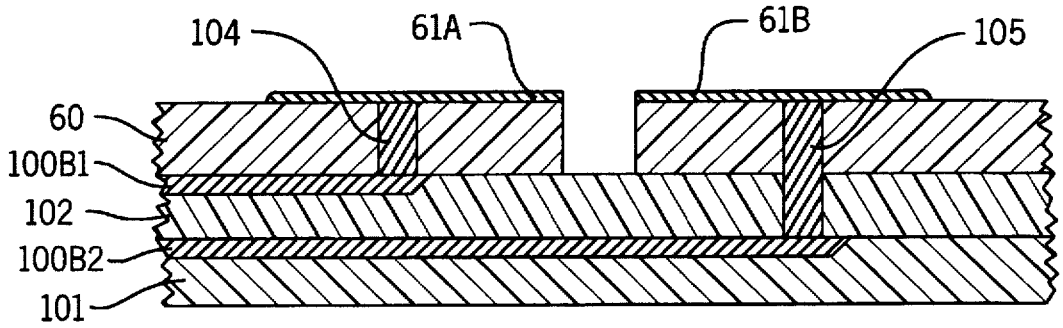
FIG. 13 is another view similar to FIG. 11 showing a third embodiment for the connections between the conductive deposits and a power source.

FIG. 13 shows another variant configuration in which a first conductive trace 100B1 is printed on the lower surface of substrate 60 and is connected to conductive deposit 61A by feedthrough 104. A second printable substrate 102 underlies the first printable substrate 60, and a second conductive trace 100B2 is printed on the lower surface thereof. A second feedthrough 105, extending through both the printable substrates 60, 102 connects the conductive trace 100B2 to the conductive deposit 61B. If desired, a rigid substrate 101 may be used as a lowermost layer to both stiffen the structure and electrically isolate the conductive trace 100B2 as previously described.

Figure 14:
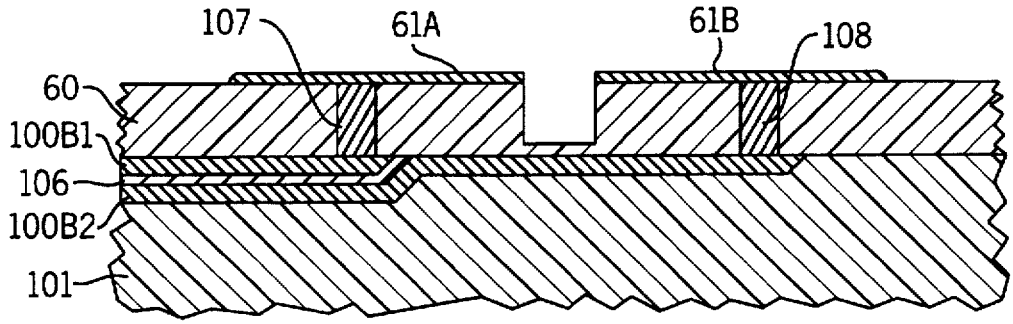
FIG. 14 is a view similar to FIG. 13 illustrating an embodiment of the invention which incorporates the use of printed insulators as well as printed conductors.

FIG. 14 illustrates an embodiment of the invention in which the conductor deposits feeding the conductive laminae 61A, 61B are embedded for safety, but which does not require the additional second substrate 102 shown in FIG. 13 to achieve this object. In this embodiment, a thin dielectric insulating layer 106 is laid down, as by printing, between the deposits 100B1 and 100B2 which feed laminae 61A, 61B via feedthroughs 107, 108, respectively. As a result, a thinner and simpler structure is obtained.

Figure 15:
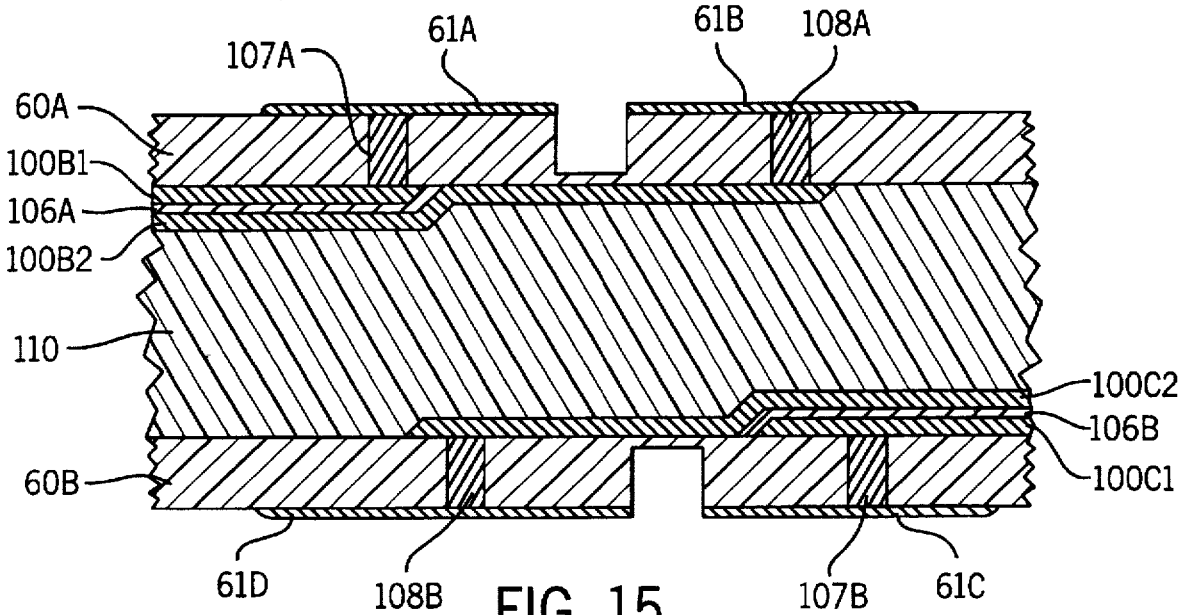
FIG. 15 is a view similar to FIG. 14 illustrating a double-sided, reversible embodiment of the invention.

As previously mentioned, a layout can be made reversible to permit the enjoyment of two different courses in a single layout structure. FIG. 15 is similar to FIG. 14, but is modified to show an exemplary construction for this embodiment. Thus, on an upper surface, there is a track which includes printed conductive laminae 61A, 61B disposed along the length of the individual vehicle's course. Lamina 61A is energized by conductive deposit 100B1 which is coupled to lamina 61A by conductive feedthrough 107A. Similarly, lamina 61B is energized by conductive deposit 100B2 which is coupled to lamina 61B by conductive feedthrough 108A. Conductive deposits 100B1 and 100B2 are insulated from one another by printed dielectric layer 106A. On the other side or lower surface of the layout, there is a track which includes printed conductive laminae 61C, 61D disposed along the length of the individual vehicle's course. Lamina 61C is energized by conductive deposit 100C1 which is coupled to lamina 61C by conductive feedthrough 107B. Similarly, lamina 61D is energized by conductive deposit 100C which is coupled to lamina 61D by conductive feedthrough 108A. Conductive deposits 100C1 and 100C2 are insulated from one another by printed dielectric layer 106B.

Figure 16:
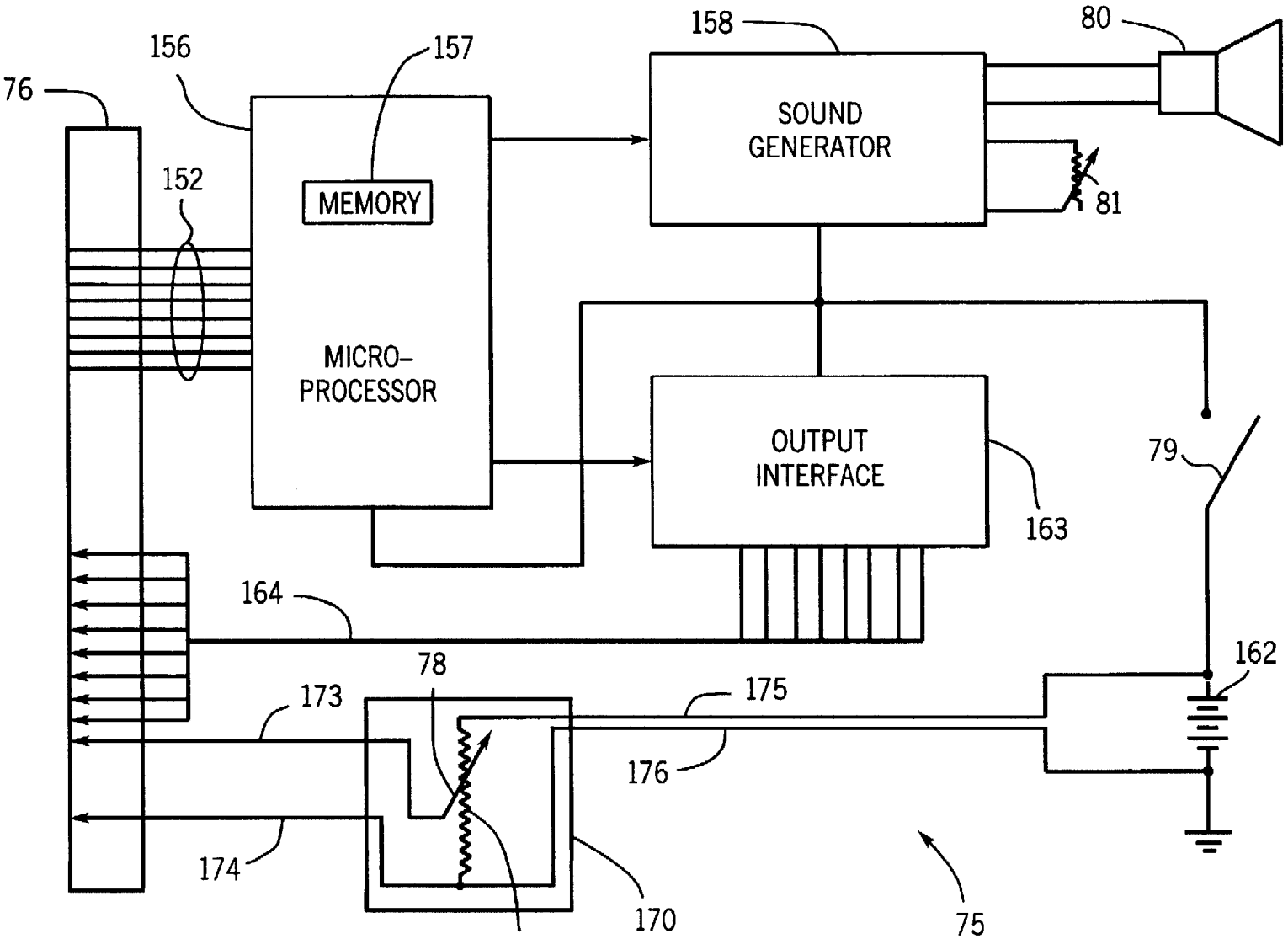
FIG. 16 is a detailed block diagram of a detachable control unit component shown in FIG. 10.

Attention is now directed to FIG. 16, which is a block diagram of the electronic components of the control unit 75, with reference also to FIG. 10. Connector 76 is adapted to engage connector 77 in such a manner as to establish electrical communication between the conductive deposits laid on the substrate 70 and the control unit. In this manner, the representative input leads 152 are brought into the control unit. On/off switch 79 is connected in series between a battery 62 and the several circuit blocks within the control unit 75. The battery 62 is merely representative of a suitable source of d-c voltage/current, and it will be understood that a conventional power supply energized from an ordinary wall outlet is also appropriate to supply electrical energy to the system.

The input lines 152 are coupled to a microprocessor 156 which includes a memory 57 in which a plurality of sequences of sounds are stored. Depending upon the identification of an active input signal, in effect, actuated by the position of one of the vehicles on the course, a predetermined audio drive signal sequence is sent to sound generator 158 which drives speaker 80 to render the audio passage signal (e.g., the previously exemplified tire screeching sound) audible. The output volume of the sound issued by speaker 80 may be controlled by volume control 81. Those skilled in the art will understand that the memory for the storage of the sound passages may alternatively be incorporated in the sound generator. At the state-of-the-art, all the components employed in the control unit are available off-the-shelf, and it is only necessary to support and interconnect them on a suitable control unit printed circuit (not shown). Further, it is possible, at the state-of-the-art of integrated circuit technology to combine all the electronic components into a single, special purpose chip if the economics are rationalized.

The purpose of output interface block 163 is to provide for the incorporation of visual and audible enhancements to the layout under the direction of the microprocessor 156. For example, as previously discussed, timers, lap counters, signal lights, etc. may be selectively actuated and driven by output signals placed on the output line set 164 from the output interface 163. In addition, as also previously discussed, the sound effects may be selectively reproduced in the speakers 96, 97, 98, 99 to provide enhanced realism over the reproduction of the sound effects from the speaker 78 which is integral with the control unit 75 and may be deemed optional for layouts which include the speakers on the substrate 70 itself.

Speed control unit 170 may take diverse conventional forms as are well known in the art. A simple voltage divider is shown for simplicity and includes variable potentiometer 172 connected across the battery 162 via lines 175, 176. Manual control 78 is a variable tap of the potentiometer 172 and permits the direct manipulation of the voltage transferred to the controlled model vehicle via the lines 173, 174, the connectors 76, 75 and the conductive deposits 100B and 61A, 61B, all as previously described.

While the materials and techniques which may be employed in practicing the invention are widely diverse, certain particulars of these materials and techniques as presently preferred will be found useful in readily fully understanding the invention. Any printing equipment that is capable of effecting selective solid coverage ink transfer distribution can be utilized to lay the conductive and dielectric deposits as required for a given layout.

Suitable printing equipment include Gravere and Flex-O-Press printing presses and screen printing apparatus. Standard multi-station offset printing presses can also be utilized, if properly configured to deposit the conductive traces in "solid coverage"; i.e., so that the conductive ink deposited by the press printing units does not include any interstices. That is to say, in such a manner that the dots of conductive ink deposited by the press overlap or overlay to provide a continuous conductive path.

Specifically, web-fed offset printing presses typically include a number of successive print stations. Each print station is associated with a particular color, and, typically, includes upper and lower sets of rollers to selectively apply ink of that color to both sides of the web (i.e., foldable sheet 1) on a substantially concurrent basis. The web passes through the respective printing stations in sequence to develop a multi-color image. Each printing station applies its respective ink in accordance with an associated dot matrix (corresponding to a color separation) established by a plate. The operation of the individual units is coordinated so that the respective images as printed are in registry. The combinations of colors and relative dispositions of the matrices provide a composite image having the desired form, composition, and color.

Thus, for example, the pictorial aspects and conductive laminae for engaging the vehicle brushes on the upper surface of a layout on the one hand and some or all the conductive and dielectric traces on the lower surface of a layout on the other hand can be concurrently printed employing one set (e.g., the upper) of print rollers in the respective stations to lay down the pictorial aspects and conductive laminae and the other set (e.g., the lower) of print rollers in the stations to deposit the conductive and dielectric inks. Disposition of a continuous, sufficiently thick, conductive path along each conductive trace can be facilitated by employing a plurality of successive print stations, each applying the conductive ink in sequence. The respective dot matrices laid down by the successive units are preferably slightly offset, but overlap each other. The dots of ink, in effect, bleed together to ensure a continuous conductive path. This result can be facilitated by laying the conductive ink down more thickly than is typical for non conductive ink in a typical color process. A suitable flexible dielectric ink to use in insulating overlapping conductive traces from one another as described is the product marketed by Olin Hunt Specialty Products Inc., a subsidiary of the Olin Corporation of Ontario, Calif., under the name "37AC22 Curable Spacer".

The printable substrate 70 is preferably made of non-conductive material capable of accepting flexible conductive ink. Any material which will accept the inks employed, such as a heavy paper or suitably coated or otherwise prepared plastic and which can be folded without breakage, is acceptable. The material used may vary from pure paper to pure synthetic substances, including a variety of composite materials. For example, the products sold by Paper Sources International under the trademark "Chromolux" and by the Champion International Corporation under the trademark "Cromekote" consist of paper coated on both sides with a layer of synthetic material, available in overall thicknesses from approximately 6 to 18 thousands of an inch. The product marketed by the Kimberly-Clark Corporation under the trademark "Kimdura" consists entirely of synthetic paper, a polypropylene material, available in thicknesses ranging from about 3 to 12 thousands of an inch. The materials marketed by the Spring Hill Paper Company under the trademark "Claycoat" and by the ICI Company of England under the trademark "Melinex" consist of a polyester substrate. These materials are all suitable to practice the invention and can all be folded for long-term durability in the manner described above. Thus, the term "paper" as used herein comprehends such materials as well as classical papers. Further, it is contemplated that a substrate having conductive properties may be employed by first coating the substrate surface or surfaces with the dielectric ink in at least those regions where conductive ink will be printed.

The substrate 70 may be die cut although such is not essential. To some extent, the selection of the process to cut and trim the layout material depends upon the material chosen and its thickness and also on whether the printed matter is deposited directly or on a separate sheet which is subsequently fixed to the foldable sheet.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A model vehicle system including:

A) a model vehicle track comprising:

1) a substrate having non-conductive upper and lower surfaces;

2) a path on said upper surface of said substrate, said path representing a model vehicle course; and 3) first and second conductive laminae overlaying said upper surface of said substrate and extending, mutually spaced-apart, along said path, each of said first and second conductive laminae comprising a layer of conductive ink;

B) a model vehicle comprising:

1) electrically energizable motive means having first and second electrical terminals, said motive means adapted to propel said model vehicle along said path when a voltage is applied across said first and second electrical terminals; and 2) spaced-apart first and second brush means, said first and second brush means each coupled at one end thereof to one of said electrical terminals, each said brush means having a second end depending from said model vehicle and adapted to slidingly engage and electrically contact one of said conductive laminae as said model vehicle moves along said path; and C) power supply means for selectively applying a voltage across said first and second conductive laminae;

whereby, when a voltage is applied across said first and second conductive laminae, said brush means pick up and place said voltage across said electrical terminals, thereby energizing said motive means to propel said model vehicle along said path.

2. The model vehicle system of claim 1 in which said first and second conductive laminae are each emplaced by direct printing of said conductive ink on said upper surface of said substrate.

3. The model vehicle system of claim 2 in which said substrate comprises a sheet of paper.

4. The model vehicle system of claim 3 in which said substrate further includes a stiffening layer overlaid by said sheet of paper.

5. The model vehicle system of claim 1 in which said first conductive lamina and said second conductive lamina each constitute a closed loop.

6. The model vehicle system of claim 1 in which said power supply means and said first and second laminae are electrically coupled by first and second conductive deposits overlaying at least one of said surfaces of said substrate.

7. The model vehicle system of claim 6 in which said first and second conductive laminae and said first and second conductive deposits each comprise a layer of conductive ink.

8. The model vehicle system of claim 7 in which said first and second conductive deposits are each emplaced by direct printing of said conductive ink on at least one of said upper and lower surfaces of said substrate.

9. A model vehicle system including:

A) a model vehicle track comprising:

1) a substrate having non-conductive upper and lower surfaces;

2) a first path on said upper surface of said substrate, said first path representing a first model vehicle course;

3) first and second conductive laminae overlaying said upper surface of said substrate and extending, mutually spaced-apart, along said first path, said first and second conductive laminae each comprising a layer of conductive ink;

4) a second path on said upper surface of said substrate, said second path representing a second model vehicle course; and 5) third and fourth conductive laminae overlaying said upper surface of said substrate and extending, mutually spaced-apart, along said second path, said third and fourth conductive laminae each comprising a layer of conductive ink;

B) a first model vehicle comprising:

1) electrically energizable first motive means having first and second electrical terminals, said motive means adapted to propel said first model vehicle along said one of said first and second paths when a voltage is applied across said first and second electrical terminals; and 2) spaced-apart first and second brush means, said first and second brush means each coupled at one end thereof to one of said first and second electrical terminals, each said first and second brush means having a second end depending from said first model vehicle and adapted to slidingly engage and electrically contact one of said first and second conductive laminae as said first model vehicle moves along said first path;

C) a second model vehicle comprising:

1) electrically energizable second motive means having third and fourth electrical terminals, said motive means adapted to propel said second model vehicle along said second path when a voltage is applied across said third and fourth electrical terminals; and 2) spaced-apart third and fourth brush means, said third and fourth brush means each coupled at one end thereof to one of said third and fourth electrical terminals, each said third and fourth brush means having a second end depending from said second model vehicle and adapted to slidingly engage and electrically contact one of said third and fourth conductive laminae as said second model vehicle moves along said first path;

D) first power supply means for selectively applying a voltage across said first and second conductive laminae, said first power supply means and said first and second laminae being electrically coupled by first and second conductive deposits overlaying at least one of said surfaces of said substrate, said first and second conductive deposits each comprising a layer of conductive ink;

E) second power supply means for selectively applying a voltage across said third and fourth conductive laminae, said second power supply means and said third and fourth laminae being electrically coupled by third and fourth conductive deposits overlaying at least one of said surfaces of said substrate, said third and fourth conductive deposits each comprising a layer of conductive ink;

whereby, when a voltage from said first power supply means is applied across said first and second conductive laminae, said first and second brush means pick up and place said voltage across said first and second electrical terminals, thereby energizing said first motive means to propel said first model vehicle along said first path; and, when a voltage from said second power supply means is applied across said third and fourth conductive laminae, said third and fourth brush means pick up and place said voltage across said third and fourth electrical terminals, thereby energizing said second motive means to propel said second model vehicle along said second path.

10. The model vehicle system of claim 9 in which each said conductive laminae and each said conductive deposits are emplaced by direct printing of said conductive ink on at least one of said upper and lower surfaces of said substrate.

11. The model vehicle system of claim 1 which further includes:

A) at least one sensor adapted to sense that said model vehicle is in a predetermined position along said path; and B) control means responsive to a signal received from said sensor indicating that said model vehicle is in said predetermined position for issuing a sensory response thereto.

12. The model vehicle system of claim 11 in which said sensor and said control means are electrically coupled by conductive ink traces deposited on at least one of said surfaces of said substrate.

13. The model vehicle system of claim 9 which further includes:

A) a first sensor adapted to sense that said first model vehicle is in a first predetermined position along said first path;

B) first control means responsive to a signal received from said first sensor indicating that said first model vehicle is in said first predetermined position for issuing a first sensory response thereto;

C) a second sensor adapted to sense that said second model vehicle is in a second predetermined position along said second path; and D) second control means responsive to a signal received from said second sensor indicating that said second model vehicle is in said second predetermined position for issuing a second sensory response thereto.

14. The model vehicle system of claim 13 in which said first sensor and said first control means are electrically coupled by first conductive ink traces deposited on at least one of said surfaces of said substrate; and said second sensor and said second control means are electrically coupled by second conductive ink traces deposited on at least one of said surfaces of said substrate.

15. The model vehicle system of claim 7 in which, in at least one region in which two of said first and second conductive laminae and said first and second conductive deposits cross, an insulating layer interposed therebetween to prevent an electrical short condition.

16. The model vehicle system of claim 9 in which, in at least one region in which two of said first, second, third and fourth conductive laminae and said first, second, third and fourth conductive deposits cross, an insulating layer interposed therebetween to prevent an electrical short condition.

17. The model vehicle system of claim 15 in which said insulating layer is a dielectric ink.

18. The model vehicle system of claim 16 in which said insulating layer is a dielectric ink.

19. A method for making a model vehicle layout comprising the steps of:

A) determining a vehicle path on one of first and second surfaces of a printable material;

B) printing first and second conductive ink laminae on said one of said first and second surfaces along said path; and C) printing first and second conductive ink deposits on one of said first and second surfaces to electrically couple, respectively, said first and second conductive laminae and a voltage source.

20. The method for making a model vehicle layout of claim 19 which further includes the steps of:

A) emplacing a sensor on the printable material proximate the vehicle path to sense the passing of a model vehicle; and B) printing third and fourth conductive ink deposits on one of the first and second surfaces of the printable material to electrically couple, respectively, the sensor and a control unit.

21. The method for making a model vehicle layout of claim 19 which further includes the steps of:

A) emplacing a sensory output device on one of the first and second surfaces of the printable material; and B) printing third and fourth conductive ink deposits on one of the first and second surfaces of the printable material to electrically couple, respectively, the sensory output device and a control unit.

22. The method for making a model vehicle layout of claim 20 which further includes the steps of:

A) emplacing a sensory output device on one of the first and second surfaces of the printable material; and B) printing fifth and sixth conductive ink deposits on one of the first and second surfaces of the printable material to electrically couple, respectively, the sensory output device and a control unit.

23. The method of making a model vehicle layout of claim 19 which includes the further step of, in at least one position at which two among the first and second conductive laminae and the first and second conductive deposits cross, printing a layer of dielectric ink therebetween.

24. The method of making a model vehicle layout of claim 20 which includes the further step of, in at least one position at which two among the first and second conductive laminae and the first, second, third and fourth conductive deposits cross, printing a layer of dielectric ink therebetween.

25. The method of making a model vehicle layout of claim 21 which includes the further step of, in at least one position at which two among the first and second conductive laminae and the first, second, third and fourth conductive deposits cross, printing a layer of dielectric ink therebetween.

26. The method of making a model vehicle layout of claim 22 which includes the further step of, in at least one position at which two among the first and second conductive laminae and the first, second, third, fourth, fifth and sixth conductive deposits cross, printing a layer of dielectric ink therebetween.

* * * * *